US007318028B2

(12) United States Patent
Schug et al.

(10) Patent No.: US 7,318,028 B2
(45) Date of Patent: Jan. 8, 2008

(54) METHOD AND APPARATUS FOR DETERMINING AN ESTIMATE

(75) Inventors: Michael Schug, Erlangen (DE); Johannes Hilpert, Nuernberg (DE); Stefan Geyersberger, Wuerzburg (DE); Max Neuendorf, Nuernberg (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 11/469,418

(22) Filed: Aug. 31, 2006

(65) Prior Publication Data

US 2007/0129940 A1 Jun. 7, 2007

Related U.S. Application Data

(63) Continuation of application No. PCT/EP2005/001651, filed on Feb. 17, 2005.

(30) Foreign Application Priority Data

Mar. 1, 2004 (DE) ..... 10 2004 009 949

(51) Int. Cl.
*G10L 19/00* (2006.01)

(52) U.S. Cl. ..... 704/230; 704/240; 704/219; 704/227; 704/500

(58) Field of Classification Search ..... 704/230, 704/219, 240, 227, 500
See application file for complete search history.

(56) References Cited

U.S. PATENT DOCUMENTS

| | | | | |
|---|---|---|---|---|
| 5,623,577 | A * | 4/1997 | Fielder | 704/200.1 |
| 5,627,938 | A | 5/1997 | Johnson | |
| 5,632,003 | A * | 5/1997 | Davidson et al. | 704/200.1 |
| 5,956,674 | A * | 9/1999 | Smyth et al. | 704/200.1 |
| 6,351,730 | B2 * | 2/2002 | Chen | 704/229 |
| 6,418,408 | B1 * | 7/2002 | Bhaskar et al. | 704/219 |
| 6,493,664 | B1 * | 12/2002 | Bhaskar et al. | 704/222 |

(Continued)

FOREIGN PATENT DOCUMENTS

| | | |
|---|---|---|
| EP | 0 446 037 | 6/1991 |

(Continued)

OTHER PUBLICATIONS

Temporal Noice Shaping (TNS); ISO/IEC; 14496-3; 2001 (E); pp. 105-109.

(Continued)

*Primary Examiner*—Vijay Chawan
(74) *Attorney, Agent, or Firm*—Michael A. Glenn; Glenn Patent Group

(57) ABSTRACT

For determining an estimate of a need for information units for encoding a signal, a measure for the distribution of the energy in the frequency band is taken into account in addition to the admissible interference for a frequency band and an energy of the frequency band. With this, a better estimate of the need for information units is obtained, so that coding can be done more efficiently and more accurately.

11 Claims, 7 Drawing Sheets

U.S. PATENT DOCUMENTS

| | | | | |
|---|---|---|---|---|
| 6,502,069 | B1 * | 12/2002 | Grill et al. | 704/219 |
| 6,636,830 | B1 | 10/2003 | Princen et al. | |
| 6,654,716 | B2 * | 11/2003 | Bruhn et al. | 704/219 |
| 6,871,176 | B2 * | 3/2005 | Choi et al. | 704/223 |
| 6,912,495 | B2 * | 6/2005 | Griffin et al. | 704/208 |
| 6,937,979 | B2 * | 8/2005 | Gao et al. | 704/230 |
| 6,996,523 | B1 * | 2/2006 | Bhaskar et al. | 704/222 |
| 2002/0103637 | A1 | 8/2002 | Henn et al. | |
| 2002/0173948 | A1 | 11/2002 | Hilper et al. | |

FOREIGN PATENT DOCUMENTS

| | | |
|---|---|---|
| EP | 0 856 961 | 5/1998 |

OTHER PUBLICATIONS

Psychoacoustic Model; ISO/IEC; 13818-7: 2002 (E); pp. 130-136.
James D. Johnson; Estimation of Perceptual Entropy Using Noise Masking Criteria; AT&T Bell Laboratories; CH2561-9/88/0000-2524; 1988; IEEE.

* cited by examiner $nl=4$ $nl=\sqrt{2}$ $$pe=nl(b)\cdot\log_2\left(\frac{e(b)}{nb(b)}+1{,}5\right)$$

$$pe = -\sum_{b} width(b) \cdot lg\left(\frac{nb(b)}{e(b)+1}\right)$$

$$pe=\sum_{b} width(b)\cdot \log_2\left(\frac{e(b)}{nb(b)}+1,5\right)$$

$$pe=\sum_{b}\sum_{kOffset(b)}^{kOffset(b+1)-1}\log_2\left(\frac{X^2(k)\cdot width(b)}{nb(b)}+1,5\right)$$

METHOD AND APPARATUS FOR DETERMINING AN ESTIMATE

CROSS-REFERENCE TO RELATED APPLICATION

This application is a continuation of co-pending International Application No. PCT/EP2005/001651, filed Feb. 17, 2005, which designated the United States and was not published in English and is incorporated herein by reference in its entirety.

BACKGROUND OF THE INVENTION

1. Field of the Invention

The present invention relates to coders for encoding a signal including audio and/or video information, and in particular to the estimation of a need for information units for encoding this signal.

2. Description of the Related Art

The prior art coder will be presented below. An audio signal to be coded is supplied in at an input 1000. This audio signal is initially fed to a scaling stage 1002, wherein so-called AAC gain control is conducted to establish the level of the audio signal. Side information from the scaling is supplied to a bit stream formatter 1004, as is represented by the arrow located between block 1002 and block 1004. The scaled audio signal is then supplied to an MDCT filter bank 1006. With the AAC coder, the filter bank implements a modified discrete cosine transformation with 50% overlapping windows, the window length being determined by a block 1008.

Generally speaking, block 1008 is present for the purpose of windowing transient signals with relatively short windows, and of windowing signals which tend to be stationary with relatively long windows. This serves to reach a higher level of time resolution (at the expense of frequency resolution) for transient signals due to the relatively short windows, whereas for signals which tend to be stationary, a higher frequency resolution (at the expense of time resolution) is achieved due to longer windows, there being a tendency of preferring longer windows since they result in a higher coding gain. At the output of filter bank 1006, blocks of spectral values—the blocks being successive in time—are present which may be MDCT coefficients, Fourier coefficients or subband signals, depending on the implementation of the filter bank, each subband signal having a specific limited bandwidth specified by the respective subband channel in filter bank 1006, and each subband signal having a specific number of subband samples.

What follows is a presentation, by way of example, of the case wherein the filter bank outputs temporally successive blocks of MDCT spectral coefficients which, generally speaking, represent successive short-term spectra of the audio signal to be coded at input 1000. A block of MDCT spectral values is then fed into a TNS processing block 1010 (TNS=temporary noise shaping), wherein temporal noise shaping is performed. The TNS technique is used to shape the temporal form of the quantization noise within each window of the transformation. This is achieved by applying a filtering process to parts of the spectral data of each channel. Coding is performed on a window basis. In particular, the following steps are performed to apply the TNS tool to a window of spectral data, i.e. to a block of spectral values.

Initially, a frequency range for the TNS tool is selected. A suitable selection comprises covering a frequency range of 1.5 kHz with a filter, up to the highest possible scale factor band. It shall be pointed out that this frequency range depends on the sampling rate, as is specified in the AAC standard (ISO/IEC 14496-3: 2001 (E)).

Subsequently, an LPC calculation (LPC=linear predictive coding) is performed, to be precise using the spectral MDCT coefficients present in the selected target frequency range. For increased stability, coefficients which correspond to frequencies below 2.5 kHz are excluded from this process. Common LPC procedures as are known from speech processing may be used for LPC calculation, for example the known Levinson-Durbin algorithm. The calculation is performed for the maximally admissible order of the noise-shaping filter.

As a result of the LPC calculation, the expected prediction gain PG is obtained. In addition, the reflection coefficients, or Parcor coefficients, are obtained.

If the prediction gain does not exceed a specific threshold, the TNS tool is not applied. In this case, a piece of control information is written into the bit stream so that a decoder knows that no TNS processing has been performed.

However, if the prediction gain exceeds a threshold, TNS processing is applied.

In a next step, the reflection coefficients are quantized. The order of the noise-shaping filter used is determined by removing all reflection coefficients having an absolute value smaller than a threshold from the "tail" of the array of reflection coefficients. The number of remaining reflection coefficients is in the order of magnitude of the noise-shaping filter. A suitable threshold is 0.1.

The remaining reflection coefficients are typically converted into linear prediction coefficients, this technique also being known as "step-up" procedure.

The LPC coefficients calculated are then used as coder noise shaping filter coefficients, i.e. as prediction filter coefficients. This FIR filter is used for filtering in the specified target frequency range. An autoregressive filter is used in decoding, whereas a so-called moving average filter is used in coding. Eventually, the side information for the TNS tool is supplied to the bit stream formatter, as is represented by the arrow shown between the TNS processing block 1010 and the bit stream formatter 1004 in FIG. 3.

Then, several optional tools which are not shown in FIG. 3 are passed through, such as a long-term prediction tool, an intensity/coupling tool, a prediction tool, a noise substitution tool, until eventually a mid/side coder 1012 is arrived at. The mid/side coder 1012 is active when the audio signal to be coded is a multi-channel signal, i.e. a stereo signal having a left-hand channel and a right-hand channel. Up to now, i.e. upstream from block 1012 in FIG. 3, the left-hand and right-hand stereo channels have been processed, i.e. scaled, transformed by the filter bank, subjected to TNS processing or not, etc., separately from one another.

In the mid/side coder, verification is initially performed as to whether a mid/side coding makes sense, i.e. will yield a coding gain at all. Mid/side coding will yield a coding gain if the left-hand and right-hand channels tend to be similar, since in this case, the mid channel, i.e. the sum of the left-hand and the right-hand channels, is almost equal to the left-hand channel or the right-hand channel, apart from scaling by a factor of ½, whereas the side channel has only very small values since it is equal to the difference between the left-hand and the right-hand channels. As a consequence, one can see that when the left-hand and right-hand channels are approximately the same, the difference is approximately zero, or includes only very small values which—this is the hope—will be quantized to zero in a subsequent quantizer 1014, and thus may be transmitted in a very efficient manner since an entropy coder 1016 is connected downstream from quantizer 1014.

Quantizer 1014 is supplied an admissible interference per scale factor band by a psycho-acoustic model 1020. The quantizer operates in an iterative manner, i.e. an outer iteration loop is initially called up, which will then call up an inner iteration loop. Generally speaking, starting from quantizer step-size starting values, a quantization of a block of values is initially performed at the input of quantizer 1014. In particular, the inner loop quantizes the MDCT coefficients, a specific number of bits being consumed in the process. The outer loop calculates the distortion and modified energy of the coefficients using the scale factor so as to again call up an inner loop. This process is iterated for such time until a specific conditional clause is met. For each iteration in the outer iteration loop, the signal is reconstructed so as to calculate the interference introduced by the quantization, and to compare it with the permitted interference supplied by the psycho-acoustic model 1020. In addition, the scale factors of those frequency bands which after this comparison still are considered to be interfered with are enlarged by one or more stages from iteration to iteration, to be precise for each iteration of the outer iteration loop.

Once a situation is reached wherein the quantization interference introduced by the quantization is below the permitted interference determined by the psycho-acoustic model, and if at the same time bit requirements are met, which state, to be precise, that a maximum bit rate be not exceeded, the iteration, i.e. the analysis-by-synthesis method, is terminated, and the scale factors obtained are coded as is illustrated in block 1014, and are supplied, in coded form, to bit stream formatter 1004 as is marked by the arrow which is drawn between block 1014 and block 1004. The quantized values are then supplied to entropy coder 1016, which typically performs entropy coding for various scale factor bands using several Huffman-code tables, so as to translate the quantized values into a binary format. As is known, entropy coding in the form of Huffman coding involves falling back on code tables which are created on the basis of expected signal statistics, and wherein frequently occurring values are given shorter code words than less frequently occurring values. The entropy-coded values are then supplied, as actual main information, to bit stream formatter 1004, which then outputs the coded audio signal at the output side in accordance with a specific bit stream syntax.

The data reduction of audio signals by now is a known technique, which is the subject of a series of international standards (e.g. ISO/MPEG-1, MPEG-2 AAC, MPEG-4).

The above-mentioned methods have in common that the input signal is turned into a compact, data-reduced representation by means of a so-called encoder, taking advantage of perception-related effects (psychoacoustics, psychooptics). To this end, a spectral analysis of the signal is usually performed, and the corresponding signal components are quantized, taking a perception model into account, and then encoded as a so-called bit stream in as compact a manner as possible.

In order to estimate, prior to the actual quantization, how many bits a certain signal portion to be encoded will require, the so-called perceptual entropy (PE) may be employed. The PE also provides a measure for how difficult it is for the encoder to encode a certain signal or parts thereof.

The deviation of the PE from the number of actually required bits is crucial for the quality of the estimation. Furthermore, the perceptual entropy and/or each estimate of a need for information units for encoding a signal may be employed to estimate whether the signal is transient or stationary, since transient signals also require more bits for encoding than rather stationary signals. The estimation of a transient property of a signal is, for example, used to perform a window length decision, as it is indicated in block 1008 in FIG. 3.

In FIG. 6, the perceptual entropy is illustrated as calculated according to ISO/IEC IS 13818-7 (MPEG-2 advanced audio coding (AAC)). The equation illustrated in FIG. 6 is used for the calculation of this perceptual entropy, that is to say a band-wise perceptual entropy. In this equation, the parameter pe represents the perceptual entropy. Furthermore, width(b) represents the number of the spectral coefficients in the respective band b. Furthermore, e(b) is the energy of the signal in this band. Finally, nb(b) is the corresponding masking threshold or, more generally, the admissible interference that can be introduced into the signal, for example by quantization, so that a human listener nevertheless hears no or only an infinitesimal interference.

The bands may originate from the band division of the psychoacoustic model (block 1020 in FIG. 3), or they may be the so-called scale factor bands (scfb) used in the quantization. The psychoacoustic masking threshold is the energy value the quantization error should not exceed.

The illustration shown in FIG. 6 thus shows how well a perceptual entropy determined in this way functions as an estimation of the number of bits required for the coding. To this end, the respective perceptual entropy was plotted depending on the used bits at the example of an AAC coder at different bit rates for every individual block. The test piece used contains a typical mixture of music, speech, and individual instruments.

Ideally, the points would gather along a straight line through the zero point. The expanse of the point series with the deviations from the ideal line makes the inaccurate estimation clear.

Thus, what is disadvantageous in the concept shown in FIG. 6 is the deviation, which makes itself felt in that e.g. a value too high for the perceptual entropy arises, which in turn means that it is signaled to the quantizer that more bits than actually required are needed. This leads to the fact that the quantizer quantizes too finely, i.e. that it does not exhaust the measure of admissible interference, which results in reduced coding gain. On the other hand, if the value for the perceptual entropy is determined too small, it is signaled to the quantizer that fewer bits than actually required are needed for encoding the signal. In turn, this results in the fact that the quantizer is quantizing too coarsely, which would immediately lead to an audible interference in the signal, should no countermeasures be taken. The countermeasures may be that the quantizer still requires one or more further iteration loops, which increases the computation time of the coder.

For improving the calculation of the perceptual entropy, a constant term, such as 1.5, could be introduced into the logarithmic expression, as it is shown in FIG. 7. Then a better result can already be obtained, i.e. a smaller upward or downward deviation, although it can nevertheless be seen that, when taking a constant term in the logarithmic expression into account, the case that the perceptual entropy signals too optimistic a need for bits is indeed reduced. On the other hand, it can be seen clearly from FIG. 7, however, that too high a number of bits is signaled significantly, which leads to the fact that the quantizer will always quantize too finely, i.e. that the bit need is assumed greater than it actually is, which in turn results in reduced coding gain. The constant in the logarithmic expression is a coarse estimation of the bits required for the side information.

Thus, inserting a term into the logarithmic expression indeed provides an improvement of the band-wise perceptual entropy, as it is illustrated in FIG. 6, since the bands with very small distance between energy and masking threshold are more likely to be taken into account, since a certain amount of bits is also required for the transmission of spectral coefficients quantized to zero.

A further, but very computation-time-intensive calculation of the perceptual entropy is illustrated in FIG. 8. In FIG. 8, the case in which the perceptual entropy is calculated in line-wise manner is shown. The disadvantage, however, lies in the higher computation outlay of the line-wise calculation. Here, instead of the energy, spectral coefficients X(k) are employed, wherein kOffset(b) designates the first index of band b. When comparing FIG. 8 to FIG. 7, a reduction in the upward "excursions" can be seen clearly in the range from 2,000 to 3,000 bits. The PE estimation therefore will be more accurate, i.e. not estimate too pessimistically, but rather lie at the optimum, so that the coding gain may increase in comparison with the calculation methods shown in FIGS. 6 and 7, and/or the number of iterations in the quantizer is reduced.

The computation time required to evaluate the equation shown in FIG. 8 is, however, disadvantageous in the line-wise calculation of the perceptual entropy.

Such computation time disadvantages not necessarily play any role if the coder runs on a powerful PC or a powerful workstation. But things look completely different if the coder is accommodated in a portable device, such as a cellular UMTS telephone, which on the one hand has to be small and inexpensive, on the other hand must have low current need, and additionally must work quickly, in order to enable the coding of an audio signal or video signal transmitted via the UMTS connection.

SUMMARY OF THE INVENTION

It is an object of the present invention to provide an efficient and nonetheless accurate concept for determining an estimate of a need for information units for encoding a signal.

In accordance with a first aspect, the present invention provides an apparatus for determining an estimate of a need for information units for encoding a signal having audio or video information, wherein the signal has several frequency bands, having: a measure provider for providing a measure for an admissible interference for a frequency band of the signal, wherein the frequency band includes at least two spectral values of a spectral representation of the signal, and a measure for an energy of the signal in the frequency band; a measure calculator for calculating a measure for a distribution of the energy in the frequency band, wherein the distribution of the energy in the frequency band deviates from a completely uniform distribution, wherein the measure calculator for calculating the measure for the distribution of the energy is formed to determine, as a measure for the distribution of the energy, an estimate for a number of spectral values the magnitudes of which are greater than or equal to a predetermined magnitude threshold, or the magnitudes of which are smaller than or equal to the magnitude threshold, wherein the magnitude threshold is an exact or estimated quantizer stage causing, in a quantizer, values smaller than or equal to the quantizer stage to be quantized to zero; and an estimate calculator for calculating the estimate using the measure for the interference, the measure for the energy, and the measure for the distribution of the energy.

In accordance with a second aspect, the present invention provides a method of determining an estimate of a need for information units for encoding a signal having audio or video information, wherein the signal has several frequency bands, with the steps of: providing a measure for an admissible interference for a frequency band of the signal, wherein the frequency band includes at least two spectral values of a spectral representation of the signal, and a measure for an energy of the signal in the frequency band; calculating a measure for a distribution of the energy in the frequency band, wherein the distribution of the energy in the frequency band deviates from a completely uniform distribution, wherein, as the measure for the distribution of the energy, an estimate for a number of spectral values the magnitudes of which are greater than or equal to a predetermined magnitude threshold, or the magnitudes of which are smaller than or equal to the magnitude threshold, is determined, wherein the magnitude threshold is an exact or estimated quantizer stage causing, in a quantizer, values smaller than or equal to the quantizer stage to be quantized to zero; and calculating the estimate using the measure for the interference, the measure for the energy, and the measure for the distribution of the energy.

In accordance with a third aspect, the present invention provides a computer program with program code for performing, when the program is executed on a computer, a method of determining an estimate of a need for information units for encoding a signal having audio or video information, wherein the signal has several frequency bands, with the steps of: providing a measure for an admissible interference for a frequency band of the signal, wherein the frequency band includes at least two spectral values of a spectral representation of the signal, and a measure for an energy of the signal in the frequency band; calculating a measure for a distribution of the energy in the frequency band, wherein the distribution of the energy in the frequency band deviates from a completely uniform distribution, wherein, as the measure for the distribution of the energy, an estimate for a number of spectral values the magnitudes of which are greater than or equal to a predetermined magnitude threshold, or the magnitudes of which are smaller than or equal to the magnitude threshold, is determined, wherein the magnitude threshold is an exact or estimated quantizer stage causing, in a quantizer, values smaller than or equal to the quantizer stage to be quantized to zero; and calculating the estimate using the measure for the interference, the measure for the energy, and the measure for the distribution of the energy.

The present invention is based on the finding that a frequency-band-wise calculation of the estimate of a need for information units has to be retained for computation time reasons, but that, in order to obtain an accurate determination of the estimate, the distribution of the energy in the frequency band to be calculated in band-wise manner has to be taken into account.

With this, the entropy coder following the quantizer is in a way implicitly "drawn into" the determination of the estimate of the need for information units. The entropy coding enables a smaller amount of bits to be required for the transmission of smaller spectral values than for the transmission of greater spectral values. The entropy coder is especially efficient when spectral values quantized to zero can be transmitted. Since these will typically occur most frequently, the code word for transmitting a spectral line quantized to zero is the shortest code word, and the code word for transmitting an ever-greater quantized spectral line is ever longer. Moreover, for an especially efficient concept for transmitting a sequence of spectral values quantized to zero, even run length coding may be employed, which results in the fact that in the case of a run of zeros per spectral value quantized to zero, viewed on average, not even a single bit is required.

It has been found out that the band-wise perceptual entropy calculation for determining the estimate of the need for information units used in the prior art completely ignores the mode of operation of the downstream entropy coder if the distribution of the energy in the frequency band deviates from a completely uniform distribution.

Thus, according to the invention, for the reduction of the inaccuracies of the band-wise calculation, it is taken into account how the energy is distributed within a band.

Depending on the implementation, the measure for the distribution of the energy in the frequency band may be determined on the basis of the actual amplitudes or by an estimation of the frequency lines that are not quantized to zero by the quantizer. This measure, also referred to as "nl", wherein nl stands for "number of active lines", is preferred for reasons of computation time efficiency. The number of spectral lines quantized to zero or a finer subdivision may, however, also be taken into account, wherein this estimation becomes more and more accurate, the more information of the downstream entropy coder is taken into account. If the entropy coder is constructed on the basis of Huffman code tables, properties of these code tables may be integrated particularly well, since the code tables are not calculated on-line, so to speak, due to the signal statistics, but since the code tables are fixed anyway, independently of the actual signal.

Depending on computation time limitations, in the case of an especially efficient calculation, the measure for the distribution of the energy in the frequency band is, however, performed by the determination of the lines still surviving after the quantization, i.e. the number of active lines.

The present invention is advantageous in that an estimate of a need for information contents is determined, which is both more accurate and more efficient than in the prior art.

Moreover, the present invention is scalable for various applications, since more properties of the entropy coder can always be taken into the estimation of the bit need depending on the desired accuracy of the estimate, but at the cost of increased computation time.

BRIEF DESCRIPTION OF THE DRAWINGS

These and other objects and features of the present invention will become clear from the following description taken in conjunction with the accompanying drawings, in which.

DESCRIPTION OF THE PREFERRED EMBODIMENTS

Figure 1:
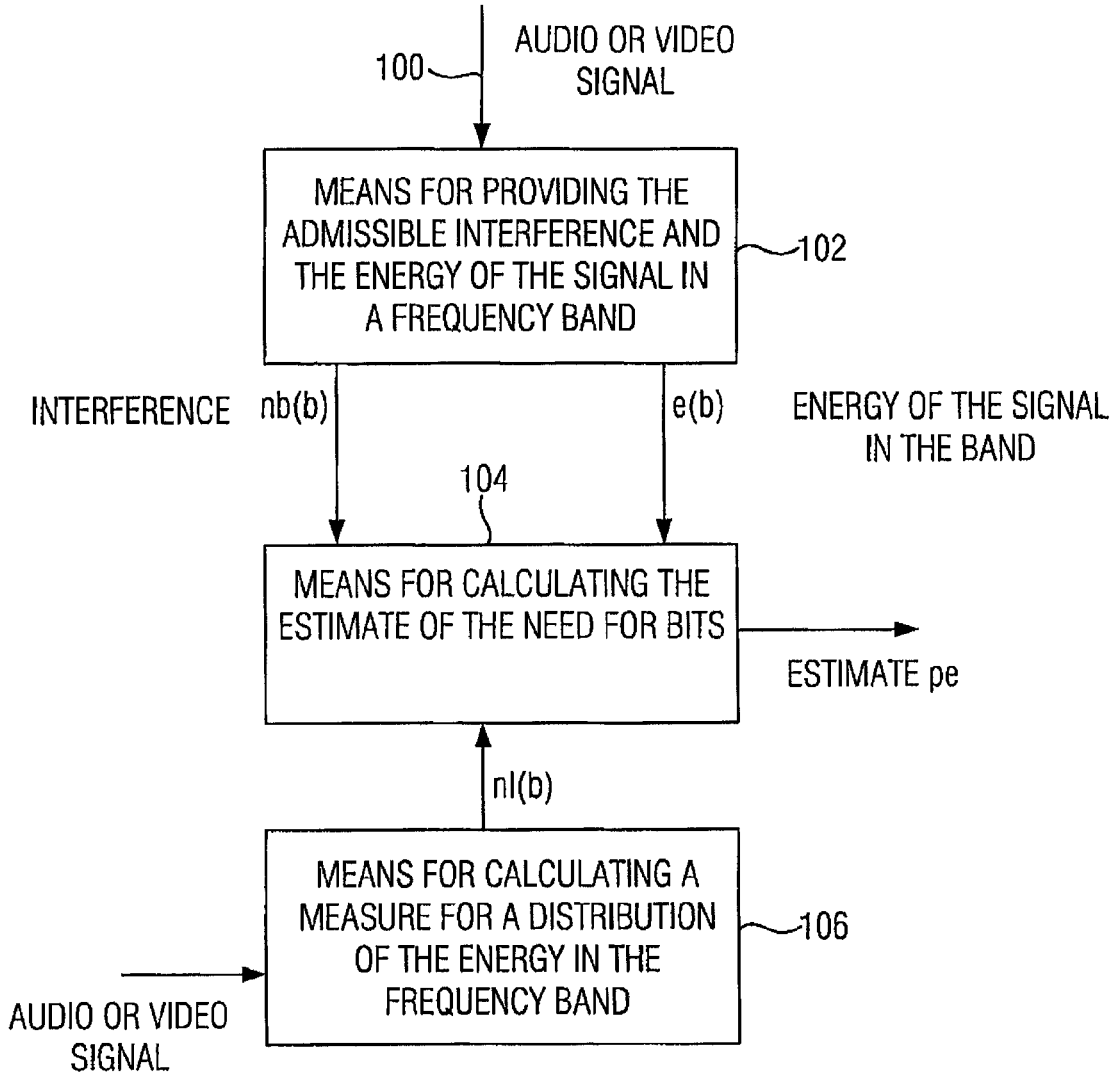
FIG. 1 is a block circuit diagram of the inventive apparatus for determining an estimate.

Subsequently, with reference to FIG. 1, the inventive apparatus for determining an estimate of a need for information units for encoding a signal will be illustrated. The signal, which may be an audio and/or video signal, is fed via an input 100. Preferably, the signal is already present as a spectral representation with spectral values. This is, however, not absolutely necessary, since some calculations with a time signal may also be performed by corresponding band-pass filtering, for example.

Figure 3:
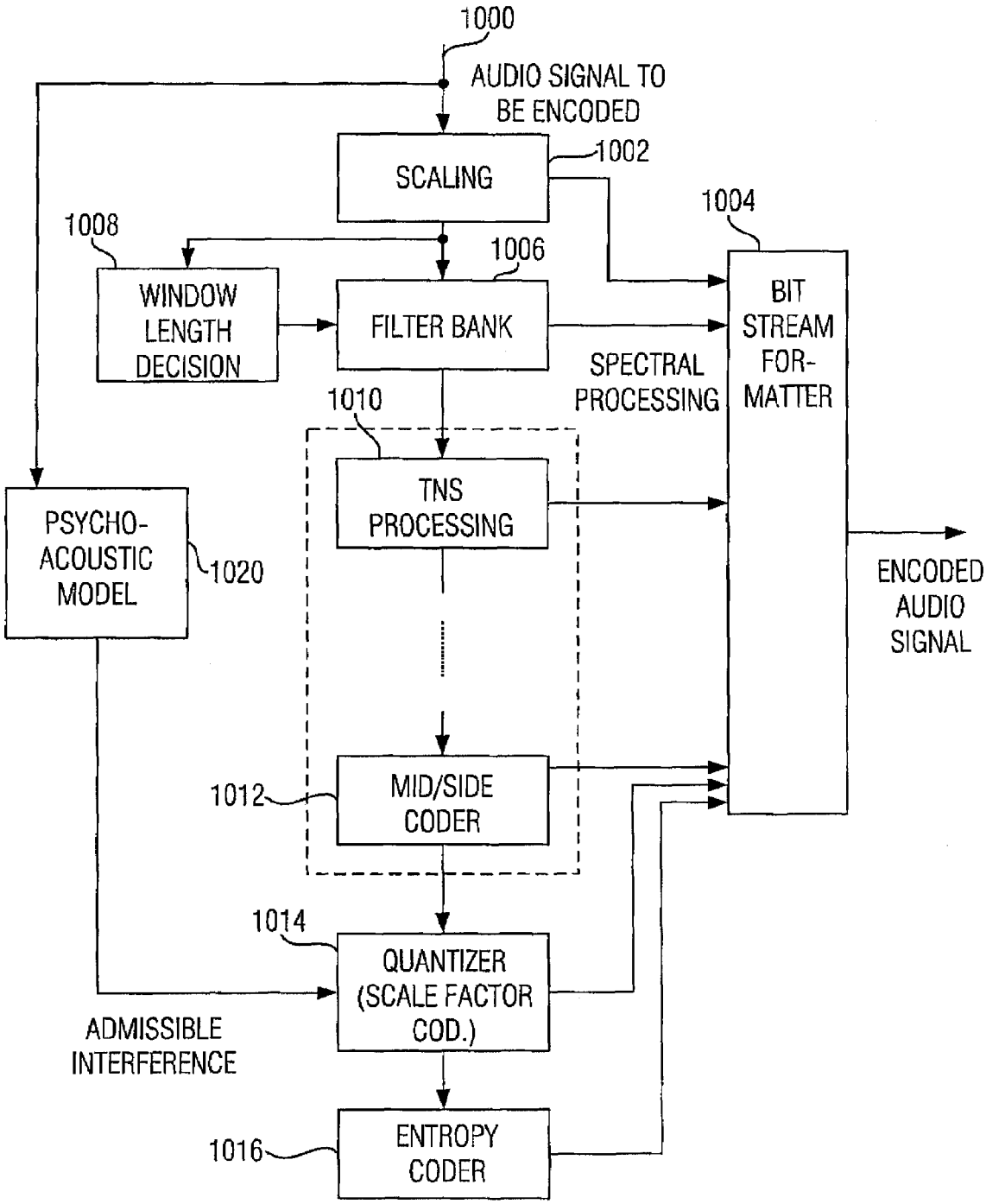
FIGURE 3 (PRIOR ART)
FIG. 3 is a block circuit diagram of a known audio coder.

The signal is supplied to a means 102 for providing a measure for an admissible interference for a frequency band of the signal. The admissible interference may for example be determined by means of a psychoacoustic model, as it has been explained on the basis of FIG. 3 (block 1020). The means 102 is further operable to provide also a measure for the energy of the signal in the frequency band. It is a prerequisite for band-wise calculation that a frequency band for which an admissible interference or signal energy is indicated contains at least two or more spectral lines of the spectral representation of the signal. In typical standardized audio coders, the frequency band will preferably be a scale factor band, since the bit need estimation is needed immediately by the quantizer to ascertain whether a quantization that took place meets a bit criterion or not.

The means 102 is formed to supply both the admissible interference nb(b) and the signal energy e(b) of the signal in the band to a means 104 for calculating the estimate of the need for bits.

According to the invention, the means 104 for calculating the estimate of the need for bits is formed to take a measure nl(b) for a distribution of the energy in the frequency band into account, apart from the admissible interference and the signal energy, wherein the distribution of the energy in the frequency band deviates from a completely uniform distribution. The measure for the distribution of the energy is calculated in a means 106, wherein the means 106 requires at least one band, namely the considered frequency band of the audio or video signal either as band-pass signal or directly as a result of spectral lines, so as to able to perform a spectral analysis of the band, for example, to obtain the measure for the distribution of the energies in the frequency band.

Of course, the audio or video signal may be supplied to the means 106 as a time signal, wherein the means 106 then performs a band filtering as well as an analysis in the band. As an alternative, the audio or video signal supplied to the means 106 may already be present in the frequency domain, e.g. as MDCT coefficients, or also as a band-pass signal in the filterbank with a smaller number of band-pass filters in comparison with an MDCT filterbank.

In a preferred embodiment, the means 106 for calculating is formed to take present magnitudes of spectral values in the frequency band into account for calculating the estimate.

Furthermore, the means for calculating the measure for the distribution of the energy may be formed to determine, as a measure for the distribution of the energy, a number of spectral values the magnitudes of which are greater than or equal to a predetermined magnitude threshold, or the magnitude of which is smaller than or equal to the magnitude threshold, wherein the magnitude threshold preferably is an estimated quantizer stage causing values smaller than or equal to the quantizer stage to be quantized to zero in a quantizer. In this case, the measure for the energy is the number of active lines, that is to say the number of lines surviving or not being equal to zero after the quantization.

Figure 2A:
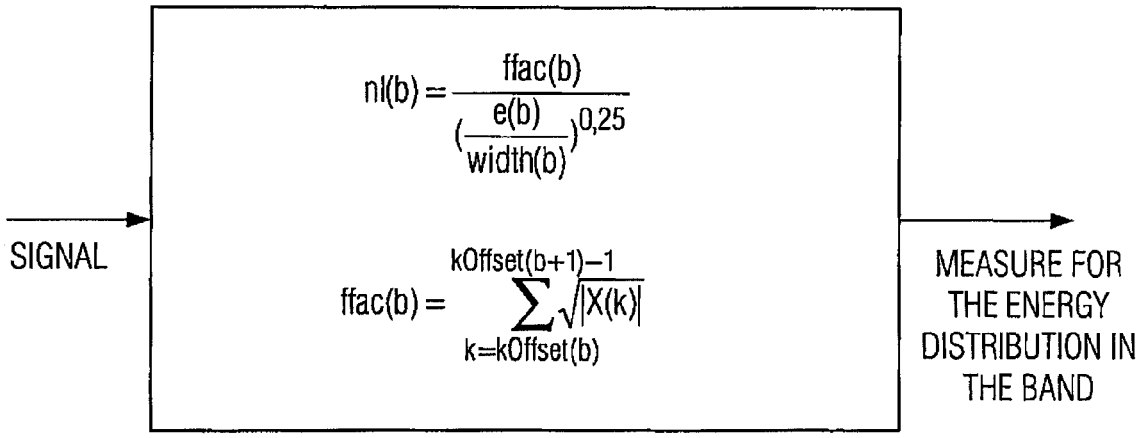
FIG. 2 shows a preferred embodiment of the means for calculation a measure for the distribution of the energy in the frequency band.
FIG. 2*b* shows a preferred embodiment of the means for calculating the estimate of the need for bits.

FIG. 2*a* shows a preferred embodiment for the means 106 for calculating the measure for the distribution of the energy in the frequency band. The measure for the distribution of the energy in the frequency band is designated with nl(b) in FIG. 2*a*. The form factor ffac(b) already is a measure for the distribution of the energy in the frequency band. As can be seen from block 106, the measure for the spectral distribution nl is determined from the form factor ffac(b) by weighting with the fourth root of the signal energy e(b) divided by the band width width(b) and/or the number of lines in the scale factor band b. In this context, it is to be pointed to the fact that the form factor is also an example for a quantity indicating a measure for the distribution of the energies, while nl(b), in contrast hereto, is an example for a quantity representing an estimate for the number of lines relevant for the quantization.

The form factor ffac(b) is calculated through magnitude formation of a spectral line and ensuing root formation of this spectral line and ensuing summing of the "rooted" magnitudes of the spectral lines in the band.

Figure 2B:
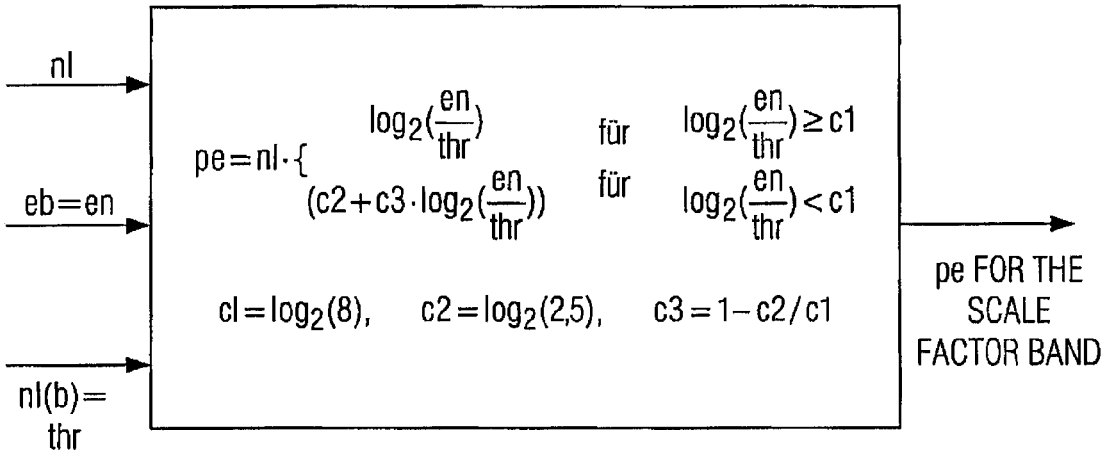

FIG. 2*b* shows a preferred embodiment of the means 104 for calculating the estimate pe, wherein a case differentiation is also introduced in FIG. 2*b*, namely when the logarithm to the base 2 of the ratio of the energy to the admissible interference is greater than a constant factor c1 or equal to the constant factor. In this case, the top alternative of the block 104 is taken, that is to say the measure for the spectral distribution nl is multiplied by the logarithmic expression.

On the other hand, if it is determined that the logarithm to the base 2 out of the ratio of the signal energy to the admissible interference is smaller than the value c1, the bottom alternative in block 104 of FIG. 2*b* is used, which additionally has also an additive constant c2 as well as a multiplicative constant c3 calculated from the constant c2 and c1.

Figure 4A:
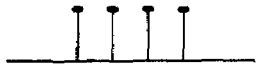
FIG. 4*a-b* is a principle illustration for the explanation of the influence of the energy distribution within a band on the determination of the estimate.
Figure 4B:
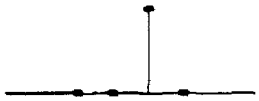

Subsequently, on the basis of FIG. 4*a* and FIG. 4*b*, the inventive concept will be illustrated. FIG. 4*a* shows a band in which four spectral lines are present, which are all equally large. The energy in this band thus is distributed uniformly across the band. By contrast, FIG. 4*b* shows a situation in which the energy in the band resides in a spectral line, while the other three spectral lines are equal to zero. The band shown in FIG. 4*b* could, for example, be present prior to the quantization or could be obtained after the quantization, if the spectral lines set to zero in FIG. 4*b* are smaller than the first quantizer stage prior to the quantization and thus are set to zero by the quantizer, i.e. do not "survive".

The number of active lines in FIG. 4*b* thus equals 1, wherein the parameter nl in FIG. 4*b* is calculated to the square root of 2. In contrast, the value nl, i.e. the measure for the spectral distribution of the energy, is calculated to 4 in FIG. 4*a*. This means that the spectral distribution of the energy is more uniform if the measure for the distribution of the spectral energy is greater.

It is to be pointed to the fact that the band-wise calculation of the perceptual entropy according to the prior art does not ascertain a difference between the two cases. In particular, if the same energy is present in both bands shown in FIGS. 4*a* and 4*b*, no difference is ascertained.

But the case shown in FIG. 4*b* can obviously be encoded with only one relevant line with fewer bits, since the three spectral lines set to zero can be transmitted very efficiently. In general, the simpler quantizability of the case shown in FIG. 4*b* is based on the fact that, after the quantization and lossless coding, smaller values and, in particular, values quantized to zero require fewer bits for transmission.

According to the invention, it is thus taken into account how the energy is distributed within the band. As it has been set forth, this is done by replacing the number of lines per band in the known equation (FIG. 6) by an estimation of the number of lines which are not equal to zero after the quantization. This estimation is shown in FIG. 2*a*.

Furthermore, it is to be pointed to the fact that the form factor shown in FIG. 2*a* is also needed at another point in the coder, for example within the quantization block 1014 for determining the quantization step-size. If the form factor is already calculated at some other point, then it does not have to be calculated again for the bit estimation, so that the inventive concept for the improved estimation of the measure for the required bits manages with a minimum of computation overhead.

As it has already been set forth, X(k) is the spectral coefficient to be quantized later, while the variable kOffset(b) designates the first index in the band b.

As can be seen from FIGS. 4*a* and 4*b*, the spectrum in FIG. 4*a* yields a value of nl=4, while the spectrum in FIG. 4*b* yields a value of 1.41. Thus, with the aid of the form factor, a measure for the quantization of the spectral field structure within the band is available.

Figure 7:
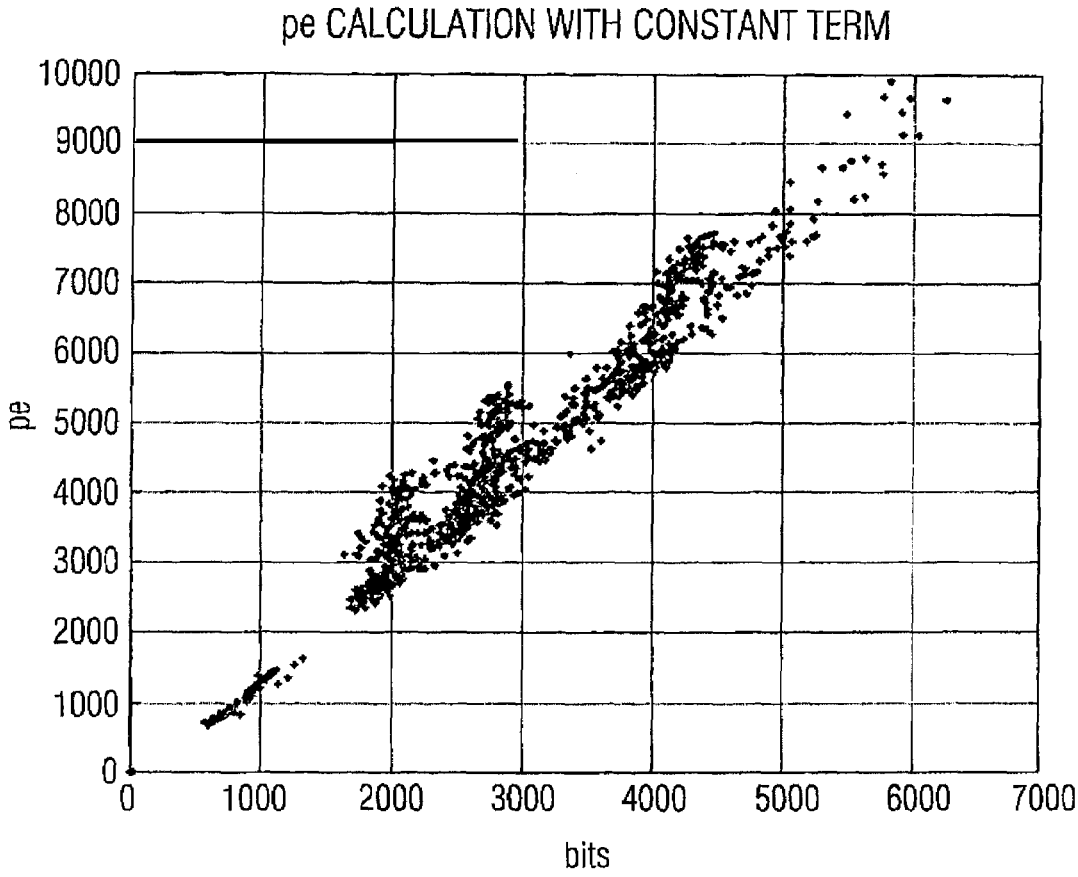
FIG. 7 is a diagram for estimate calculation with constant term.

The new formula for the calculation of an improved band-wise perceptual entropy thus is based on the multiplication of the measure for the spectral distribution of the energy and the logarithmic expression, in which the signal energy e(b) occurs in the numerator and the admissible interference in the denominator, wherein a term may be inserted within the logarithm depending on the need, as it is already illustrated in FIG. 7. This term may for example also be 1.5, but may also be equal to zero, like in the case shown in FIG. 2*b*, wherein this may determined empirically, for example.

Figure 5:
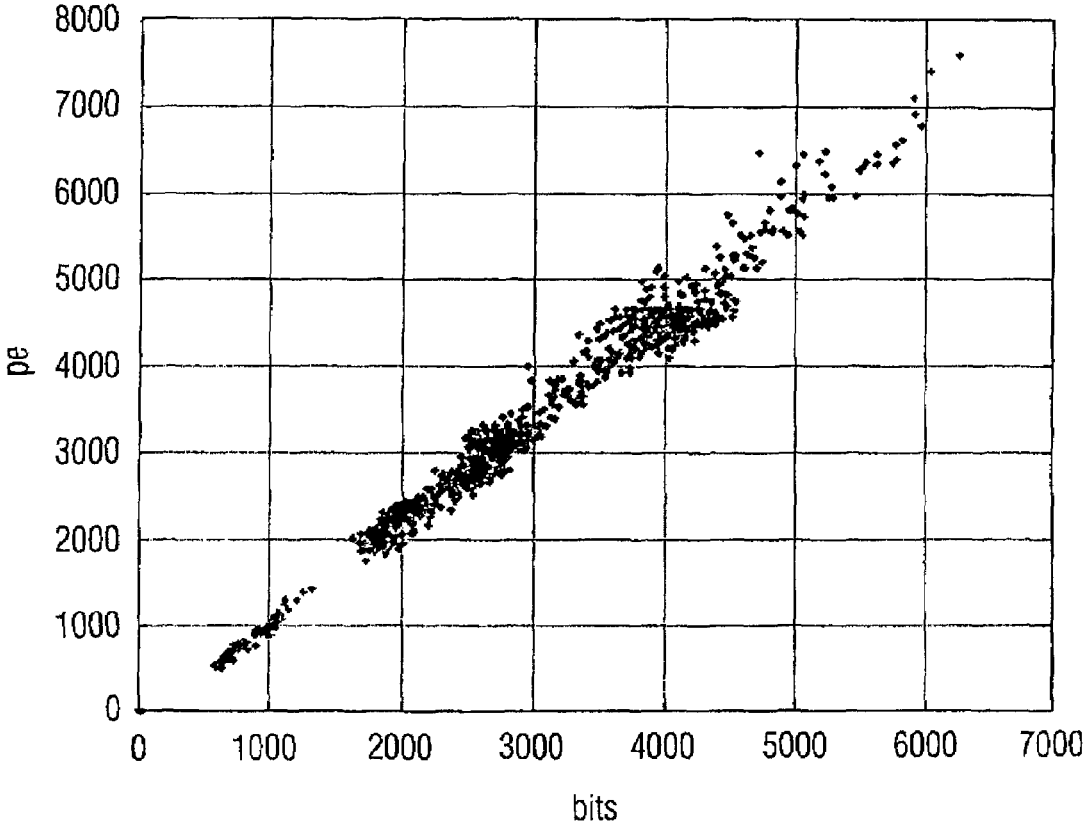
FIG. 5 is a diagram for estimate calculation according to the present invention.
Figure 6:
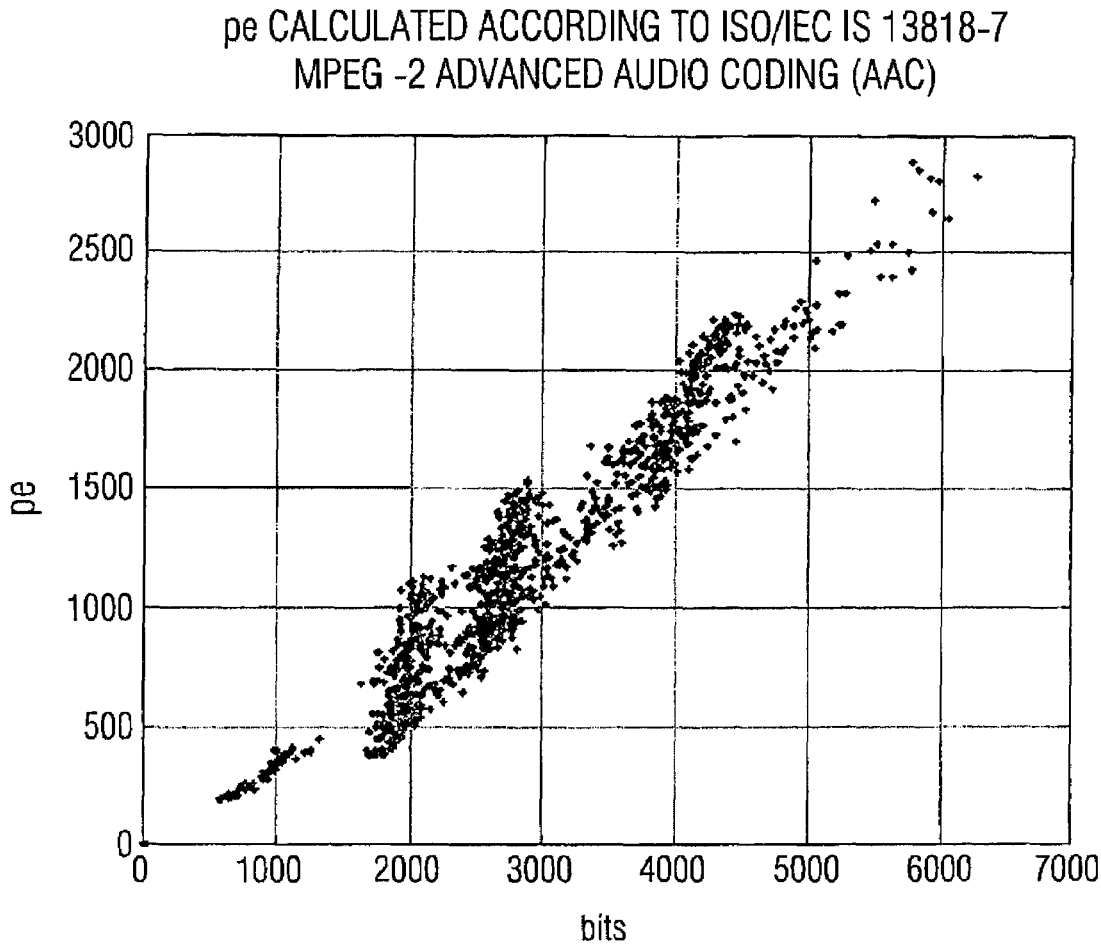
FIGURE 6 (PRIOR ART)
FIG. 6 is a diagram for estimate calculation according to ISO/IEC IS 13818-7(AAC)
Figure 8:
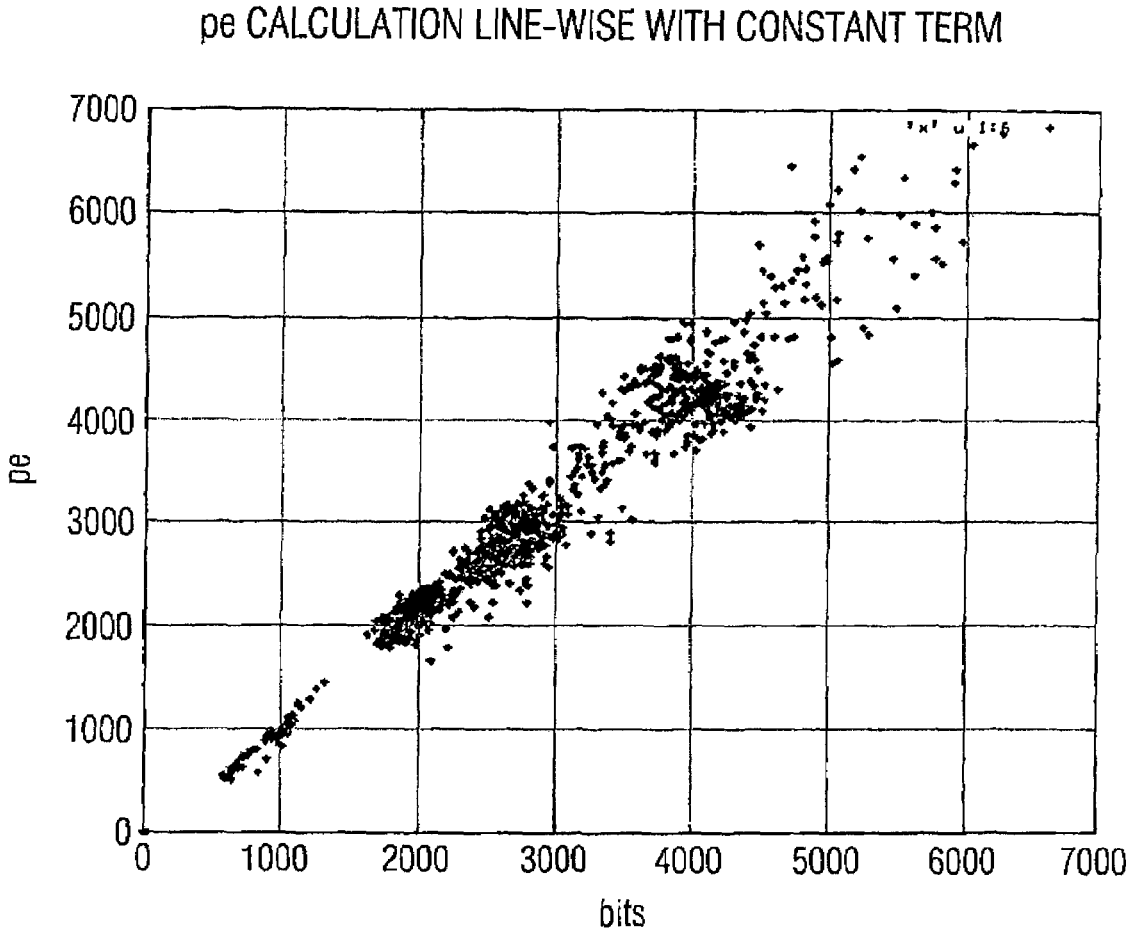
FIG. 8 is a diagram for line-wise estimate calculation with constant term.

At this point, it should once again be pointed to FIG. 5, from which the perceptual entropy calculated according to the invention is apparent, namely plotted versus the required bits. Higher accuracy of the estimation as opposed to the comparative examples in FIGS. 6, 7, and 8 is to be seen clearly. The modified band-wise calculation according to the invention also does at least as well as the line-wise calculation.

Depending on the circumstances, the method according to the invention may be implemented in hardware or in software. The implementation may be on a digital storage medium, in particular a floppy disk or CD with electronically readable control signals capable of cooperating with a programmable computer system so that the method is executed. In general, the invention thus also consists in a computer program product with program code stored on a machine-readable carrier for performing the inventive method, when the computer program product is executed on a computer. In other words, the invention may thus also be realized as a computer program with program code for performing the method, when the computer program is executed on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An apparatus for determining an estimate of a need for information units for encoding a signal having audio or video information, wherein the signal has several frequency bands, comprising:

a measure provider for providing a measure for an admissible interference for a frequency band of the signal, wherein the frequency band includes at least two spectral values of a spectral representation of the signal, and a measure for an energy of the signal in the frequency band;

a measure calculator for calculating a measure for a distribution of the energy in the frequency band, wherein the distribution of the energy in the frequency band deviates from a completely uniform distribution, wherein the measure calculator for calculating the measure for the distribution of the energy is formed to determine, as a measure for the distribution of the energy, an estimate for a number of spectral values the magnitudes of which are greater than or equal to a predetermined magnitude threshold, or the magnitudes of which are smaller than or equal to the magnitude threshold, wherein the magnitude threshold is an exact or estimated quantizer stage causing, in a quantizer, values smaller than or equal to the quantizer stage to be quantized to zero; and an estimate calculator for calculating the estimate using the measure for the interference, the measure for the energy, and the measure for the distribution of the energy.

2. The apparatus of claim 1, wherein the measure calculator is formed to take magnitudes of spectral values in the frequency band into account for the calculating the measure for the distribution of the energy.

3. The apparatus of claim 1, wherein the measure calculator is formed to calculate a form factor according to the following equation:

$$ffac(b) = \sum_{k=kOffset(b)}^{kOffset(b+1)-1} \sqrt{|X(k)|},$$

wherein X(k) is a spectral value at a frequency index k, wherein kOffset is a first spectral value in a band b, and wherein ffac(b) is the form factor.

4. The apparatus of claim 1, wherein the measure calculator is formed to take a fourth root of a ratio between the energy in the frequency band and a width of the frequency band or number of the spectral values in the frequency band into account.

5. The apparatus of claim 1, wherein the measure calculator is formed to calculate the measure for the distribution of the energy according to the following equations:

$$nl(b) = \frac{ffac(b)}{\left(\frac{e(b)}{\text{width}(b)}\right)^{0.25}}$$

$$ffac(b) = \sum_{k=kOffset(b)}^{kOffset(b+1)-1} \sqrt{|X(k)|},$$

wherein X(k) is a spectral value at a frequency index k, wherein kOffset is a first spectral value in a band b, wherein ffac(b) is a form factor, wherein nl(b) represents the measure for the distribution of the energy in the band b, wherein e(b) is a signal energy in the band b, and wherein width(b) is a width of the band.

6. The apparatus of claim 1, wherein the estimate calculator is formed to use a quotient of the energy in the frequency band and the interference in the frequency band.

7. The apparatus of claim 1, wherein the estimate calculator is formed to calculate the estimate using the following expression:

$$pe = \sum_b nl(b) \cdot \log_2\left(\frac{e(b)}{nb(b)} + s\right)$$

wherein pe is the estimate, wherein nl(b) represents the measure for the distribution of the energy in the band b, wherein e(b) is an energy of the signal in the band b, wherein nb(b) is the admissible interference in the band b, and wherein s is an additive term preferably equal to 1.5.

8. The apparatus of claim 1, wherein the estimate calculator is formed to calculate the estimate according to the following equation:

$$pe = \sum_b nl(b) \cdot \log_2\left(\frac{e(b)}{nb(b)} + s\right)$$

wherein:

$$nl(b) = \frac{ffac(b)}{\left(\frac{e(b)}{\text{width}(b)}\right)^{0.25}}, \text{ and}$$

wherein:

$$ffac(b) = \sum_{k=kOffset(b)}^{kOffset(b+1)-1} \sqrt{|X(k)|},$$

wherein pe is the estimate, wherein nl(b) represents the measure for the distribution of the energy in the band b, wherein e(b) is an energy of the signal in the band b, wherein nb(b) is the admissible interference in the band b, wherein s is an additive term preferably equal to 1.5, wherein X(k) is a spectral value at a frequency index k, wherein kOffset is a first spectral value in a band b, wherein ffac(b) is a form factor, and wherein width(b) is a width of the band.

9. The apparatus of claim 1, wherein the signal is given as a spectral representation with spectral values.

10. A method of determining an estimate of a need for information units for encoding a signal having audio or video information, wherein the signal has several frequency bands, comprising the steps of:

providing a measure for an admissible interference for a frequency band of the signal, wherein the frequency band includes at least two spectral values of a spectral representation of the signal, and a measure for an energy of the signal in the frequency band;

calculating a measure for a distribution of the energy in the frequency band, wherein the distribution of the energy in the frequency band deviates from a completely uniform distribution, wherein, as the measure for the distribution of the energy, an estimate for a number of spectral values the magnitudes of which are greater than or equal to a predetermined magnitude threshold, or the magnitudes of which are smaller than or equal to the magnitude threshold, is determined, wherein the magnitude threshold is an exact or estimated quantizer stage causing, in a quantizer, values smaller than or equal to the quantizer stage to be quantized to zero; and calculating the estimate using the measure for the interference, the measure for the energy, and the measure for the distribution of the energy.

11. A computer program with program code for performing, when the program is executed on a computer, a method of determining an estimate of a need for information units for encoding a signal having audio or video information, wherein the signal has several frequency bands, comprising the steps of:

providing a measure for an admissible interference for a frequency band of the signal, wherein the frequency band includes at least two spectral values of a spectral representation of the signal, and a measure for an energy of the signal in the frequency band;

calculating a measure for a distribution of the energy in the frequency band, wherein the distribution of the energy in the frequency band deviates from a completely uniform distribution, wherein, as the measure for the distribution of the energy, an estimate for a number of spectral values the magnitudes of which are greater than or equal to a predetermined magnitude threshold, or the magnitudes of which are smaller than or equal to the magnitude threshold, is determined, wherein the magnitude threshold is an exact or estimated quantizer stage causing, in a quantizer, values smaller than or equal to the quantizer stage to be quantized to zero; and calculating the estimate using the measure for the interference, the measure for the energy, and the measure for the distribution of the energy.

* * * * *